US005412733A

United States Patent [19]

Nagayoshi et al.

[11] Patent Number: 5,412,733

[45] Date of Patent: May 2, 1995

[54] ACOUSTIC REPRODUCING APPARATUS

[75] Inventors: Atsushi Nagayoshi, Neyagawa; Koichi Higuchi; Kazutoshi Yamaguchi, both of Hirakata; Eiichi Takakura, Neyagawa; Masataka Saito, Hirakata; I. Fusanori, Ikoma, all of Japan

[73] Assignee: Matsushita Electric Industrial Co., Ltd., Kadoma, Japan

[21] Appl. No.: 142,115

[22] Filed: Oct. 28, 1993

Related U.S. Application Data

[63] Continuation of Ser. No. 761,344, Nov. 6, 1991, abandoned.

[30] Foreign Application Priority Data

Jan. 19, 1990 [JP] Japan ..... 2-11455
Apr. 16, 1990 [JP] Japan ..... 2-100072

[51] Int. Cl.[6] ..... H04R 1/10
[52] U.S. Cl. ..... 381/74; 381/98
[58] Field of Search ..... 381/25, 74, 98, 94

[56] References Cited

U.S. PATENT DOCUMENTS 4,461,026 7/1984 Priniski .
4,629,834 12/1986 Waggoner et al. ..... 381/74

FOREIGN PATENT DOCUMENTS 0122663 10/1984 European Pat. Off. .
0130613 1/1985 European Pat. Off. .
58-003305 1/1983 Japan .
59-091090 6/1984 Japan .
59-031051 9/1984 Japan .
60-145714 8/1985 Japan .
60-223284 11/1985 Japan .
60-223284 11/1985 Japan .
1-17596 1/1989 Japan ..... 381/72

*Primary Examiner*—Forester W. Isen
*Attorney, Agent, or Firm*—Cushman, Darby & Cushman

[57] ABSTRACT

The present invention relates to an acoustic reproducing apparatus which is suitable particularly for listening to reproduced sound with noise through an open-air-type head phone. A sound leakage frequency band, when a head phone is loaded is measured in advance, and operation of a filter attenuating that sound leakage frequency band is changed-over. Thereby the sound leakage from the head phone to the outside in the loaded state is controlled. Also, a noise frequency characteristic is measured in advance, the low frequency band is intensified so as to correspond to that characteristic, and operation of the filter for attenuating the high frequency band containing the above-mentioned sound leakage frequency band is controlled to be changed-over.

3 Claims, 7 Drawing Sheets

ACOUSTIC REPRODUCING APPARATUS

This is a continuation of application Ser. No. 07/761,344, filed on Nov. 6, 1991.

TECHNICAL FIELD

The present invention relates to an acoustic reproducing apparatus for performing sound reproduction for listening through an open-air-type head phone, for example, in conjunction with a portable-type tape player, CD player or the like.

TECHNICAL BACKGROUND

In recent years, acoustic reproducing apparatuses using an open-air-type head phone have been found in large number among acoustic reproducing apparatuses such as a small-sized stereo cassette tape player and portable CD player due to the more increased outdoor application in the acoustic field.

The above-mentioned open-air-type head phone includes what is generally called a head phone with a head band which covers the ears and an inner-type head phone loaded in the ears; but the above-mentioned acoustic reproducing apparatuses using these head phones include cassette tape players, portable CD players, radio receivers with FM stereo and apparatuses combining these apparatuses, any of which is of a small size which is convenient for carrying. Then, even in the case of outdoor listening, owing to the open-air type as mentioned above, the sound and alarm of vehicles, signal sound and the like can be listened to, and sound reproduction and listening can be performed without any danger while walking outdoors.

However, the configuration as mentioned above is an open-air-type and allows the outside voice to be heard, therefore having a problem of being affected directly by the surrounding noise and leaking the reproduced sound from the head phone into the surroundings.

This problem means that, as shown in FIG. 10, measurements of noise frequency characteristics in an environment of listening in an electric car and in a motor car result in a noise frequency characteristic in electric car B and a noise frequency characteristic in motorcar C in contrast with a flat frequency characteristic A of the acoustic reproducing apparatus. Both the frequency characteristic B and C have high noise levels of low frequency band and low noise levels of high frequency band although the frequency bands thereof somewhat deviate from each other. Accordingly, there exists a problem that where the output of the reproducing apparatus having the frequency characteristic A is intended to be listened to, the sound of the low frequency band is buried in noise and is hard to be listened to either in an electric car or in a motorcar, and the voice of the high frequency band is emphasized, and that when the sound volume is increased to listen better to the low frequency band, the high frequency band is more emphasized. This causes a similar problem also, for example, in the case of listening alone through the head phone in an electric car or listening alone through the head phone in a motorcar.

Also, in an electric car, the open-air-type head phone causes a problem of sound leakage to the surroundings. FIG. 11 is a graph showing a sound leakage frequency characteristic D of a conventional open-air-type head phone measured under a condition as shown in FIG. 12. This means that measurements of sound leakage are made by a sound level meter M positioned apart by l (about 30 cm) from an ear La in the state that a head phone H is attached to the ear La of a listener L.

Here. the surrounding environment is a soundproof chamber, and the sound level meter M uses a A-curve filter. As a result, as shown in FIG. 11, the sound leakage increases at frequencies above 1 kHz, thereby showing a sound leakage frequency characteristic Da and showing such a frequency characteristic Db that the dark noise level of the soundproof chamber is flat in the frequency band below 1 kHz. Thus, it is found that the sound leakage is generated largely in the high frequency band, and this becomes a problem as a cause of sound leakage in the case of listening through the above-mentioned open-air-type head phone.

As described above, conventionally, when reproduced sound is intended to be listened to in an electric car or in a motorcar, low-pitched tones are very hard to be listened due to the noise In that place, and by resultant increasing of the sound volume, high-pitched tones are extraordinally emphasized, and a problem is caused that the listener himself gets tired of listening. Furthermore, as is the case with listening in an electric car, where many people are present in the surroundings, the noise from the surrounding electric car also exists, and the sound volume is likely to be made large; consequently the surrounding people hear the voice leaking from the head phone as annoying noise, and causes a problem of annoyance.

DISCLOSURE OF THE INVENTION

In the light of the above-mentioned problems, the present invention has been achieved for the purpose of providing an acoustic reproducing apparatus which is not affected by the noise characteristic of an electric car or a motorcar as mentioned above, and suppresses sound leakage as small as possible. and thereby can perform a sound reproduction comfortable to the listener himself and to the surrounding people.

To solve the above-mentioned problems, the acoustic reproducing apparatus of the present invention is configurated as follows:

(1) In a noisy environment such as in an electric car or in a motorcar wherein the apparatus is used, a noise frequency characteristic frequency-analyzing the noise volume thereof is measured in advance, and there is installed a filter which attenuates the high frequency band and intensifies the low frequency band in a manner to correspond to the above-mentioned noise frequency characteristic, and also a control switch which changes-over this filter operation.

(2) In the above-mentioned configuration of Item (1), there are installed a first filter and a second filter which attenuate the high frequency band and intensify the low frequency band In a manner to correspond respectively to the electric car noise frequency characteristic and the motorcar noise frequency characteristic, and also a control switch which changes-over operation of this first or second filter and non-operation of the both filters, and by changing-over the above-mentioned control switch, control is performed to obtain a frequency characteristic of a reproduction signal corresponding to the noise frequency characteristics in the electric car or in the motorcar.

(3) A frequency characteristic of sound leakage to the outside in the state that the head phone is loaded is measured in advance, and there is installed an attenuating filter which attenuates the sound leakage frequency characteristic, and also a control switch which changes-over the operation of this attenuating filter.

(4) In the above-mentioned configuration of Item (3), the frequency of the maximum attenuation level of the attenuating filter is matched with the frequency of the maximum level in the sound leakage frequency band measured in advance.

(5) In the above-mentioned configuration of Item (3), the attenuating filter has a sharp attenuation characteristic wherein 4–8 kHz are frequencies of the maximum attenuation level and attenuation at 1 kHz being the vocal center-frequency is nearly zero.

(6) The noise frequency characteristic frequency-analyzing the noise volume in a noisy environment wherein the apparatus is used and the frequency band of sound leakage to the outside in the state that the head phone is loaded are measured in advance, and there are provided an intensifying-filter for intensifying the low frequency band in a manner to correspond to the above-mentioned noise frequency characteristic, and an attenuating-filter for attenuating the above-mentioned sound leakage frequency band and a control switch for changing-over the operations of the above-mentioned both filters.

By the above-mentioned configuration, the apparatus of the present invention, by performing filtering operation through changing-over the control switch, intensifies the low-pitched tone part of the frequency characteristic of the reproduced output, attenuates the high-pitched tone part, and thereby the reproduced frequency characterstic is controlled in a manner to correspond to the noise frequency characteristic, thereby suppressing the effect of the noise and attenuating the sound leakage when the head phone is used to the utmost.

Furthermore, the apparatus attenuates the leakage of the voice in the sound leakage frequency band from the head phone to the outside by turning on or off the change-over switch.

Furthermore, the apparatus makes the frequency characteristic of the reproduced signal correspond to the above-mentioned noise characteristic by changing-over the control switch, and can attenuate the sound leakage from the head phone to the outside in the state that the head phone is loaded.

THE BEST FORM FOR EMBODYING THE INVENTION

Hereinafter, description is made on an acoustic reproducing apparatus of a first embodiment of the present invention in reference to drawings.

Figure 1:
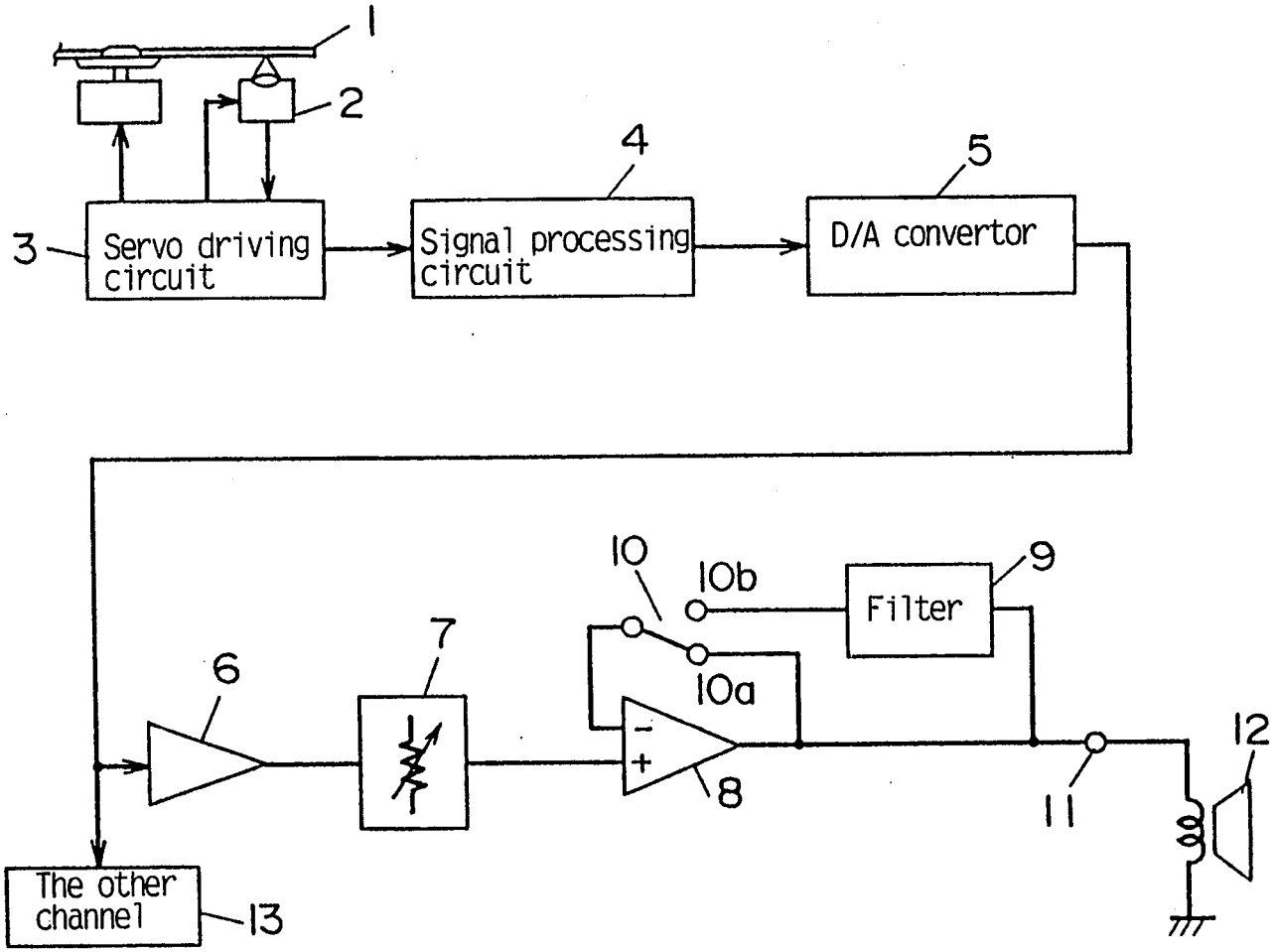
FIG. 1 is a block diagram showing a first embodiment of the present invention.

FIG. 1 is a schematic circuit block diagram of an acoustic reproducing apparatus in an embodiment of the present invention, which is a portable CD player, and shows one channel of a stereo type. In FIG. 1, numeral 1 designates a CD (Compact Disk) record; numeral 2 designates a traversing mechanism containing an optical pickup reading a signal from the C1) record 1; numeral 3 designates a servo driving circuit which accurately controls the traversing mechanism 2; numeral 4 designates a signal, processing circuit for processing a signal read by the traversing mechanism 2; numeral 5 designates a D/A converter for converting a digital signal after signal processing by the signal processing circuit 4 into an analog signal; numeral 6 designates a buffer amplifier of the D/A converter 5; and numeral 7 designates a volume control knob for controlling the amount of output of the buffer amplifier 6. Numeral 8 designates a head phone driving amplifier, which not only drives a head phone but also operates as an operational amplifier of a filter 9 as described later. Numeral. 9 designates a filter which is inserted in the feedback circuit of the head phone driving amplifier 8, and when this filter is inserted in the feedback circuit by a control switch 10 as described later, the input/output frequency characteristics of the head phone driving amplifier 8 are varied. Numeral 10 designates an On/OFF control switch of filtering operation; numeral 11. designates a head phone connecting terminal whereto the output of the head phone driving amplifier 8 is connected; numeral 12 designates one channel of the head phone connected to the head phone connecting terminal 11. Numeral 13 designates the other channel, which is configurated with the same circuit from the buffer amplifier 6 to the head phone 12.

Figure 2:
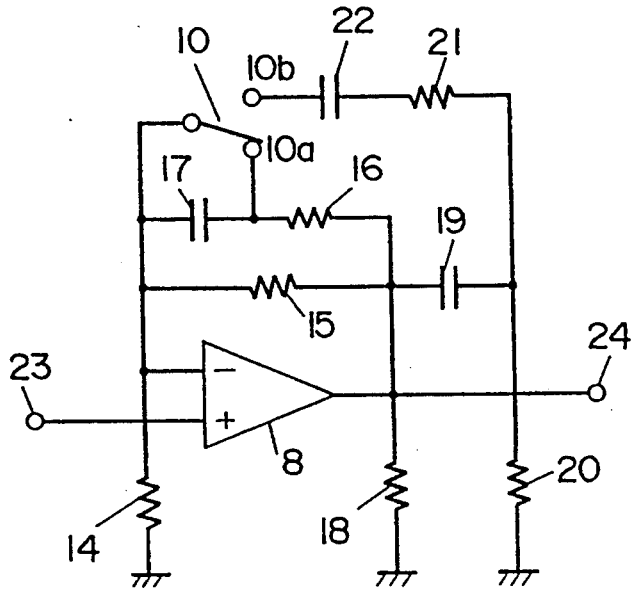
FIG. 2 is a circuit diagram of a major part of the same.

FIG. 2 is a circuit diagram showing details of the filter 9, including from the above-mentioned head phone driving amplifier 8 to the control switch 10. In FIG. 2, numerals 8 and 10 designate the above-mentioned head phone driving amplifier and control switch, respectively. Numeral 10*a* designates a filter-off-side terminal of the control switch 10; and numeral 10*b* designates a filter-on-side terminal of the control switch 10. Numerals 14 and 15 designate resistors to become gain setting elements determining input/output gains of the head phone driving amplifier 8. Resistors 16 and 18 and a condenser 17 operate as part of the gain setting elements of head phone driving amplifier 8 when the control switch 10 is turned to the filter-off-side terminal 10*a*, and operate as low-frequency-band intensifying filter elements for intensifying the low-frequency-band and becomes part, of the above-mentioned filter 9 when the control switch 10 is turned to the filter-on-side terminal 10*b*. Condensers 19 and 22 and resistors 20 and 21 operate as high-frequency-band attenuating filter elements attenuating the high frequency band and similarly becomes part of the above-mentioned filter 9, only when the change-over switch 10 is turned to the filter-on-side terminal 10*b*. Numeral 28 designates an input terminal of this circuit, and numeral 24 designates an output terminal of the same.

Figure 3:
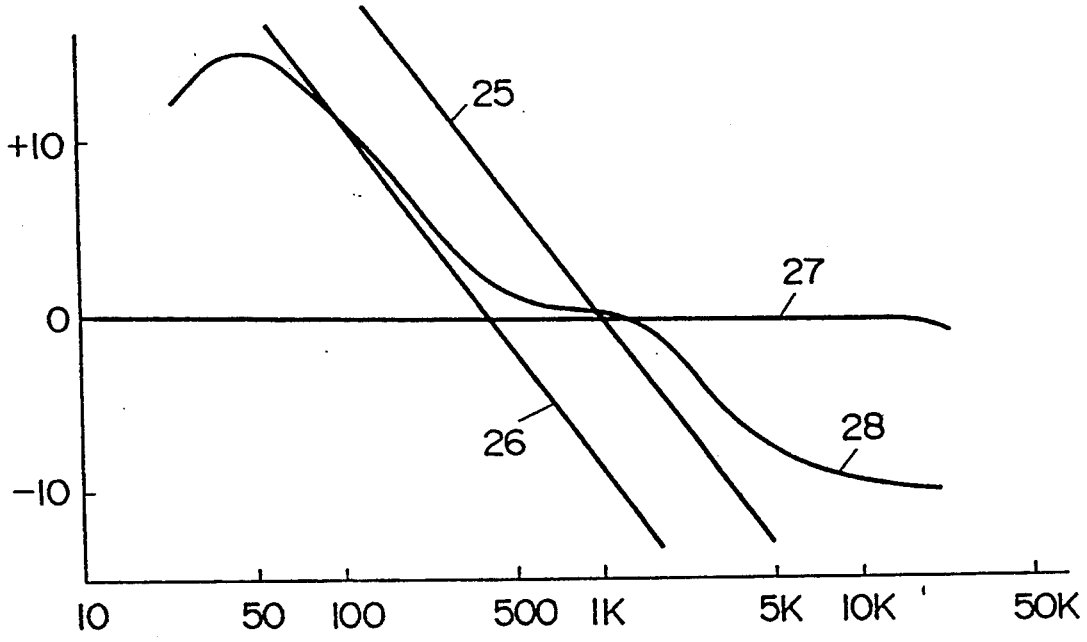
FIG. 3 is a frequency characteristic graph of the same
Figure 10:
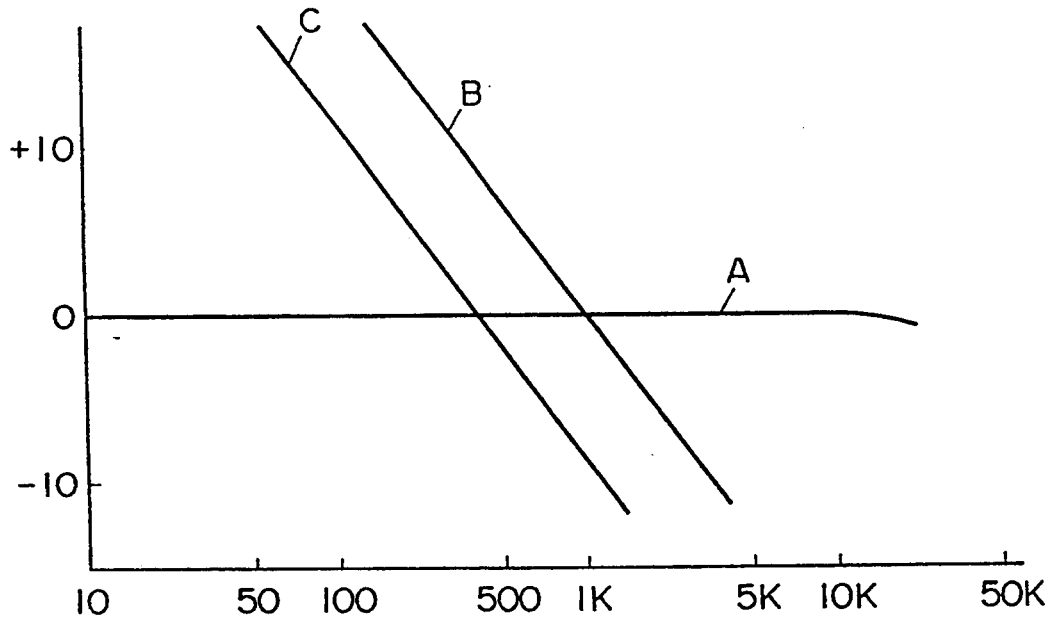
FIG. 10 is a graph showing noise frequency characteristics in an electric car and in a motorcar.

FIG. 3 is a frequency characteristic graph showing relationships among input-output characteristics of the circuit as shown in FIG. 2 and the above-mentioned electric car noise frequency characteristic and motorcar noise frequency characteristic as shown in FIG. 10. In the figure, numeral 25 designates an electric car noise frequency characterstic, numeral 26 designates a motorcar noise frequency characteristic, numeral 27 designates a frequency characteristic of reproduced output in an off state of operation of the above-mentioned filter 9, and numeral 28 designates a frequency characteristic of reproduced output in on state of operation of the same filter 9.

Hereinafter, the description is made on operation of the acoustic reproducing apparatus configurated as described above using FIG. 1, FIG. 2 and FIG. 3.

Figure 8:
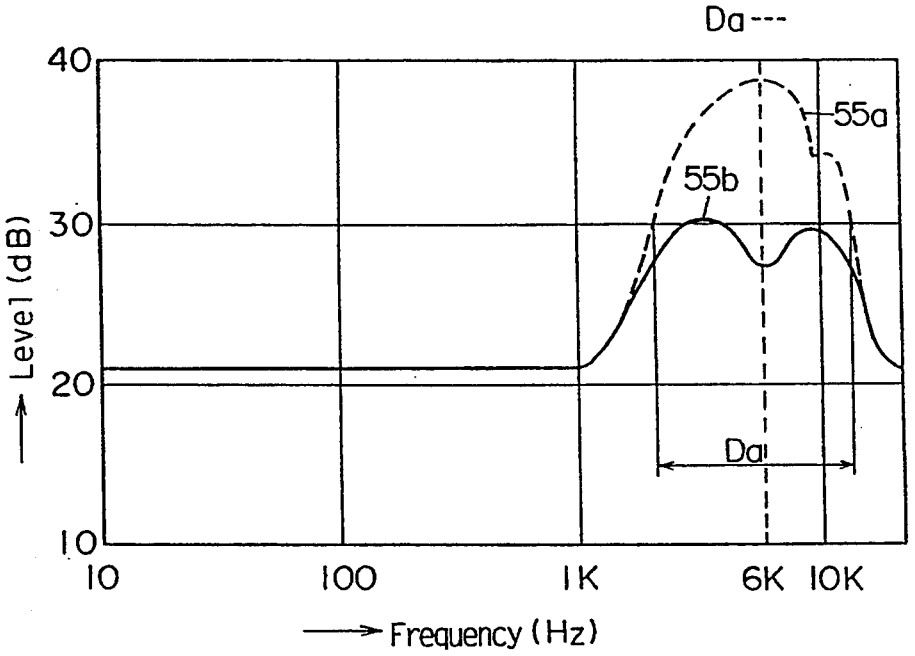
FIG. 8 is a sound leakage frequency characteristic showing a first effect in the third embodiment.

In FIG. 8, as is obvious from the electric car noise frequency characteristic 25, the motorcar noise frequency characteristic 26 and the frequency characteristic 27 in the off state of operation of the above-mentioned filter 9, the noise of the low frequency band is large but: the noise of the high-frequency-band is small both in the electric car and In the motorcar. Accordingly, it is hard for the listener to listen to the low-frequency-band part of output from the head phone 12 owing to disturbance by the noise, and in reverse, is easy to listen to the high frequency band because the S/N ratio thereof to the noise can be taken large. Then, when the control switch 10 is turned to the filter-on-side terminal 10*b*, the reproduced output shows the frequency characteristic 28 in the on state of operation of the filter 9 wherein the low frequency band is intensified and the high frequency band is attenuated. Therefore, it is easy for the listener to listen to the low frequency band of output from the head phone 12 without being disturbed by the noise because it is intensified; and in the reverse, the high frequency band part which was to be listened too annoyingly is attenuated. Therefore the listener can listen to a balanced sound. In addition, since a portion Da of the high frequency band part leaking from the head phone as shown In FIG. 8 is attenuated, the apparatus can also prevent the surrounding person in an electric car or a motorcar from being annoyed by the sound leakage.

As described above, according to this embodiment, the electric car noise frequency characteristic 25 and the motorcar noise frequency characteristic 26 are measured in advance, and the filter, 9 which attenuates the high frequency band and intensifies the low frequency band in a manner to correspond to the above-mentioned noise frequency characteristics, and the control switch 10 which changes-over the operation thereof are installed. By turning on or off the control switch 10 as shown in FIG. 3, a nicely balanced sound can be provided in the case where listening to reproduced sound in noise is necessary, and sound leakage into the surroundings when using the open-air-type head phone can be reduced.

Next, description is made on an acoustic reproducing apparatus of a second embodiment.

Figure 4:
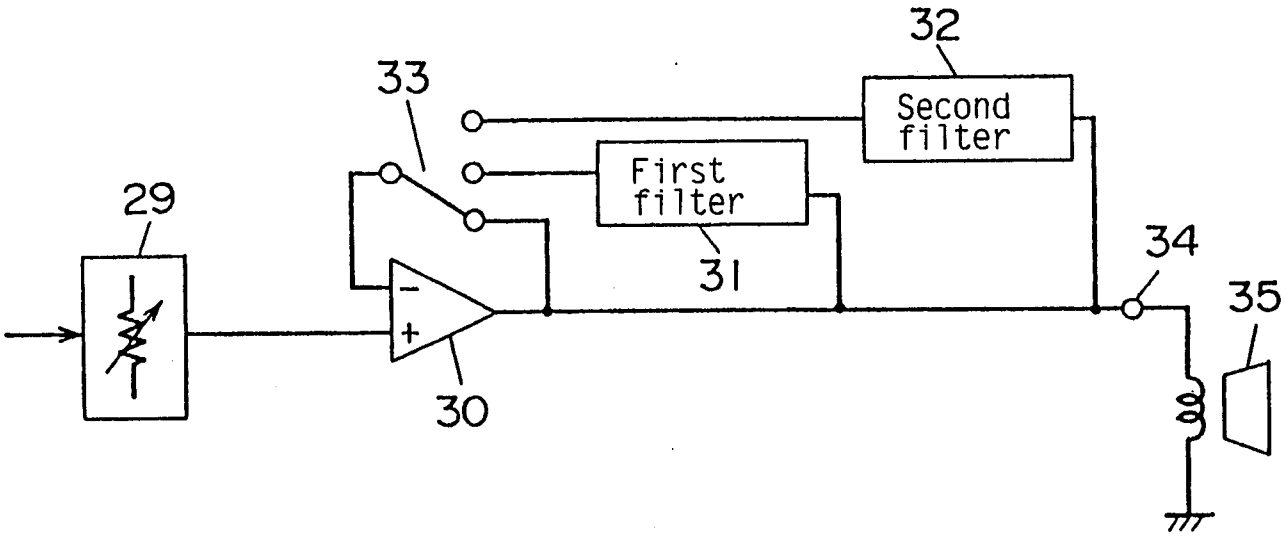
FIG. 4 is a block diagram showing a second embodiment of the present invention.

FIG. 4 is a schematic circuit block diagram showing an acoustic reproducing apparatus in a second embodiment of the present invention, which is a partial modification of the first embodiment. In FIG. 4, numeral 29 designates a volume adjusting knob for controlling the amount of output from the preceding stage. Numeral 30 designates a head phone driving amplifier, which not only drives the head phone but also operates as an operational amplifier of the filter as described later. Numeral 31 designates a first filter inserted in a feedback circuit of the head phone driving amplifier 30, which is set so as to measure the electric car noise frequency characteristic in advance and attenuate the high frequency band part and intensify the low frequency band part so as to correspond that noise frequency characteristic. When it is inserted in the feedback circuit by a control switch 33 as described later, the input/output frequency characteristics of the head phone driving amplifier 30 are changed. Numeral 32 designates a second filter inserted in the feed back circuit of the head phone driving amplifier 30, which has a characteristic different from that of the above-mentioned first filter 31, and is set so as to measure the motorcar noise frequency characteristic in advance and attenuate the high frequency band and intensify the low frequency band part so as to correspond that noise frequency characteristic. When it is inserted in the feedback circuit by the control switch 33 as described later, the input/output frequency characteristics are changed into a characteristic different from that of the first filter. Numeral 33 designates an ON/-OFF control switch of filtering operation; numeral 34 designates a head phone connecting terminal whereto the output of the head phone driving amplifier 30 is connected; and numeral 35 designates one of channels of the head phone connected to the head phone connecting terminal 34.

Hereinafter, description is made on the operation of the acoustic reproducing apparatus configurated as described above using FIG. 3 and FIG. 4. In the above-mentioned FIG. 3, as is obvious from the electric car noise frequency characteristics 25 and the motorcar noise frequency characteristic 26, both the noise frequency characteristics clearly differ from each other, and the optimum first filter 31 and second filter 32 corresponding to the respective noise frequency characteristics are installed, and the control switch 33 is changed-over by an arbitrary selection of the listener, and thereby a balance sound suitable for the surrounding environment of the listener is reproduced. In addition, the high frequency band part leaking from the head phone is attenuated in matching with the surrounding environment, and therefore the apparatus can prevent the surrounding people in an electric car or in a motorcar from being annoyed by the sound leakage.

As described above, in accordance with the second embodiment, the electric car noise frequency characterstic 25 and the motorcar noise frequency characteristic 26 are measured in advance, and the first filter 31 and the second filter 32 which attenuate the high frequency band and intensify the low frequency band and the control switch 33 of the operations thereof are installed so as to correspond to the above-mentioned respective noise frequency characteristics. By changing-over the control switch 33, a nicely balanced sound can be provided when listening to reproduced sound noise is necessary; and the sound leakage to the surroundings when using the open-air-type head phone can be reduced.

In addition, in the above-described embodiment, the characteristics of the filters are set in a manner of being limited to the electric car noise frequency characteristic and the motorcar noise frequency characteristic. But, for example, in an environment where noise having a characteristic of a conveyance such as an airplane is generated, when the noise frequency characteristic of the surrounding environment is measured in advance, and a filter characteristic corresponding to that noise frequency characteristic is set, a similar effect is obtained.

Also, in the above-described embodiment, for the state of listening to a reproduction signal, description is made on the case of listening through the open-air-type, but it may be the case of listening through a speaker. For example, in the case of listening in a car sound reproduction can be performed also through speakers of a car-stereo, but in this case, the reproduced sound and the noise in the car room are listened to in a mixed fusion. Accordingly, when sound reproduction is performed by the above-described apparatus of the present invention, a nicely balanced sound can be reproduced even if listening is performed by speaker reproduction in noise in a car.

Next, description is made on an acoustic reproducing apparatus of a third embodiment of the present invention. This embodiment aims at attenuation of the sound leakage frequency band Da in FIG. 11 as described above, and eliminates an unnatural feeling in listening to the high frequency band part without particularly attenuating the high frequency band there being no problem of sound leakage.

Figure 5:
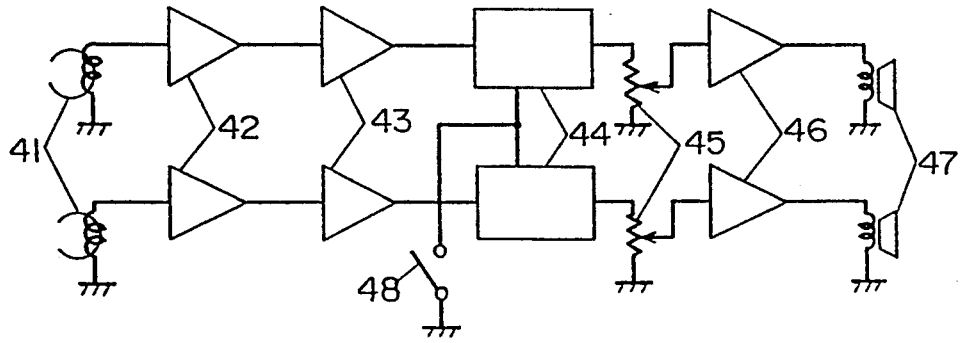
FIG. 5 is a schematic circuit block diagram of an acoustic reproducing apparatus in a third embodiment of the present invention.

FIG. 5 is a schematic circuit block diagram of an acoustic reproducing apparatus in the third embodiment of the present invention, which shows a stereo type of tape player. In FIG. 5: numeral 41 designates magnetic heads For picking up a voice electric signal from a magnetic tape (not illustrated); numeral 42 designates preamplifiers each incorporating an equalizer circuit; numeral 43 designates noise reduction circuits; numeral 44 designates attenuating filters installed independently in the right and left channels for the purpose of inputting output signals of the noise reduction circuits 43, and outputting them while attenuating only a specific frequency band part thereof; numeral 45 designates volume knobs for receiving the output of the attenuating filters; numeral 46 designates power amplifiers with low-pitched tone intensifying circuits which contain circuits for boosting the low-pitched tone band and can drive low-impedance loads; numeral 47 designates inner-type head phones; and numeral 48 designates a control switch, which can change-over the attenuating-filters to operation or non-operation (state that input/output lave no frequency characteristic).

Figure 6:
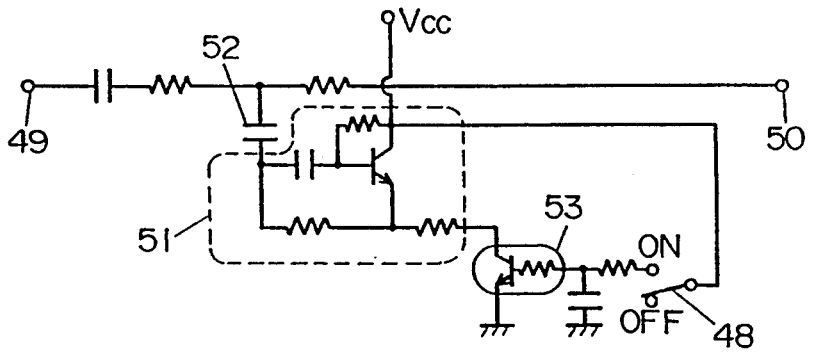
FIG. 6 is a circuit diagram representing in detail one block in FIG. 5.

FIG. 6 is a detailed circuit diagram showing only a channel of one side of the above-mentioned attenuating filter 44 and the control switch 48. In FIG. 6, numerals 49 and 50 designate an input terminal and an output terminal of the attenuating filter 44, respectively. Numeral 51 designates a semiconductor inductor configurated with one transistor, and numeral 52 designates a resonance condenser connected in series to the semiconductor inductor 51 to cause series resonance. In addition, numeral 53 designates a switching circuit for supplying the output of the above-mentioned control switch 48 to the above-mentioned semiconductor inductor 51.

Hereinafter, description is made on the operation of the acoustic reproducing apparatus configured as described above using FIG. 5, FIG. 6 and FIG. 7.

Figure 7:
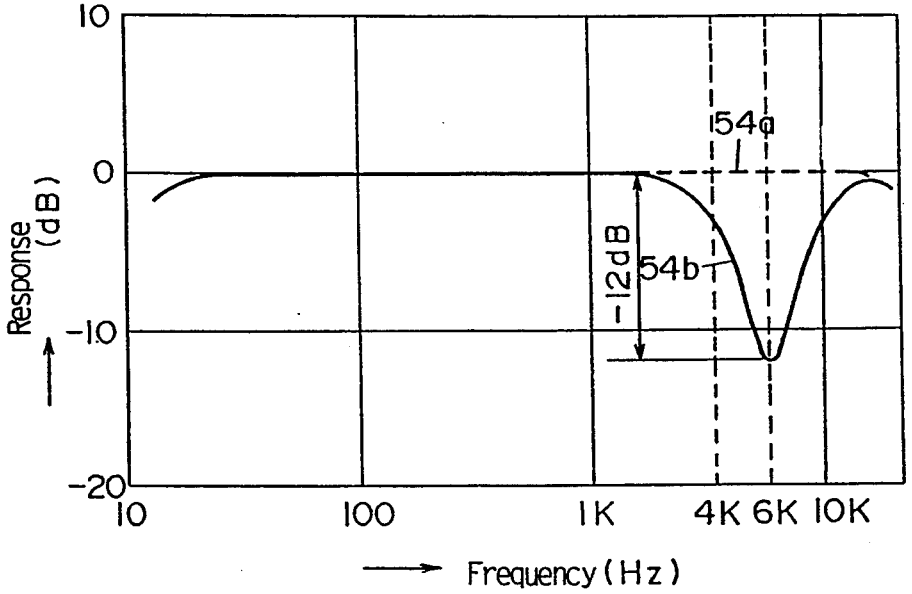
FIG. 7 is a frequency characteristic graph in the third embodiment.
Figure 11:
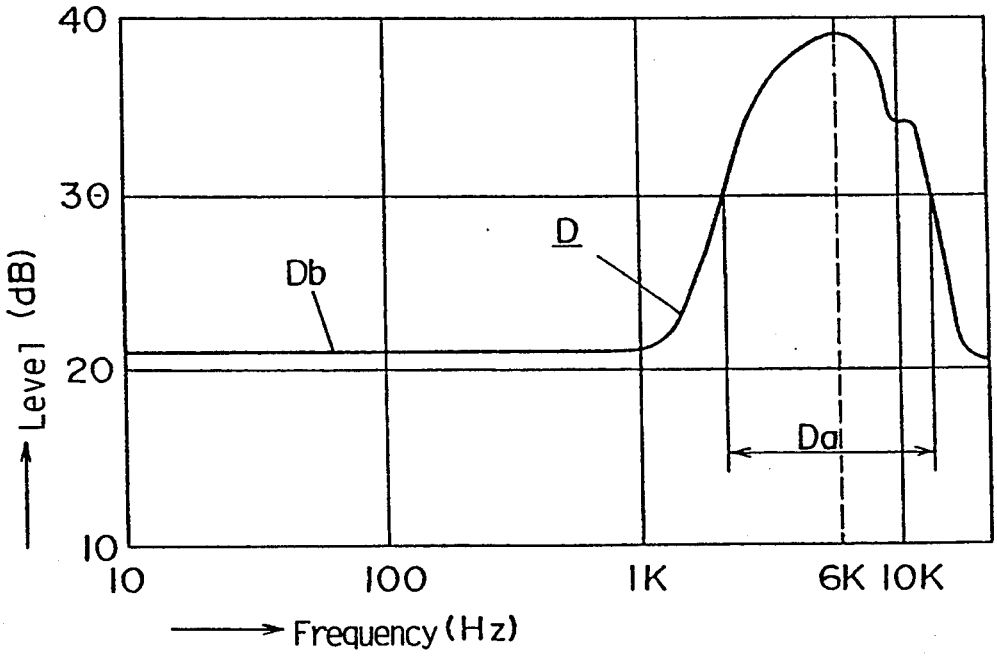
FIG. 11 is a graph showing a frequency characteristic of sound leakage from an open-air-type head phone of a conventional acoustic reproducing apparatus.
Figure 12:
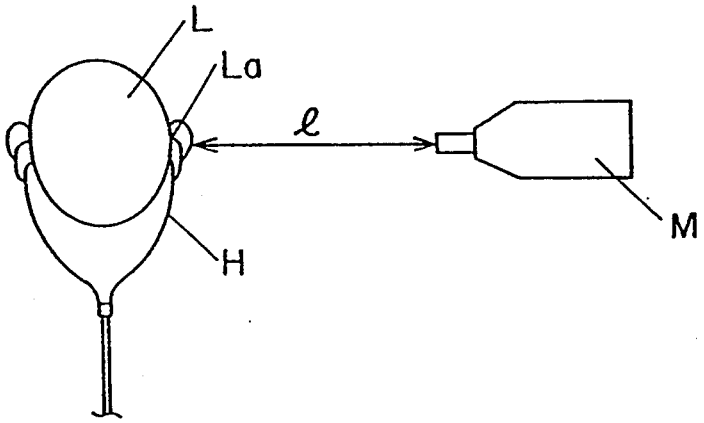
FIG. 12 is a schematic diagram showing a state of measurement in obtaining the characteristic in FIG. 11.

The attenuating filter 44 is a notch filter which corresponds to a frequency (6 kHz) of the maximum level value of the sound leakage frequency characteristic measured in advance as shown in the above-described FIG. 11, and takes this frequency (6 kHz) as the maximum value of attenuation. Accordingly, for the series resonance circuit configurated with the semiconductor inductor 51 and the resonance condenser 52, the constants thereof are determined in a manner that the resonance frequency thereof is 6 kHz. As is obvious from when the control switch 48 is in the ON state, the semiconductor inductor 51 is energized and operates, and thereby time resonance circuit works, and the attenuating filter 44 works as a notch filter whose center frequency is 6 kHz. In reverse, when the control switch 48 is in the OFF state, the semiconductor inductor 51 is not energized, and therefore the attenuating filter 44 does not operate as a notch filter, and no frequency characteristic is given between the input 49 and the output 50. Thus, the frequency characteristic of the whole circuit block in FIG. 5 becomes as shown in FIG. 7. In FIG. 7, numerals 54*a* and 54*b* designate frequency characteristics when the control switch 48 is in the OFF state and in the ON state, respectively. In addition, as is obvious from FIG. 7, for the characteristic of the attenuating filter 44, Q value of the resonance circuit is made as high as possible for the purpose of almost eliminating the effect on 1 kHz part which is the center frequency of vocal sound, and of enhancing the attenuating effect at 6 kHz as high as possible. Thus, 12 dB is realized as the attenuation level at 6 kHz.

As described above, according to the third embodiment, by installing the attenuating filter 44, for attenuating the sound leakage frequency band, and the control switch 48 for changing-over the operation thereof, it becomes possible to reduce the sound leakage by turning the control switch 48 on or off. Therefore, the sound leakage can be reduced when required. In FIG. 8, numeral 55*a* and 55*b* show frequency characteristics when the control switch 48 is in the OFF state and in the ON state, respectively.

Figure 9:
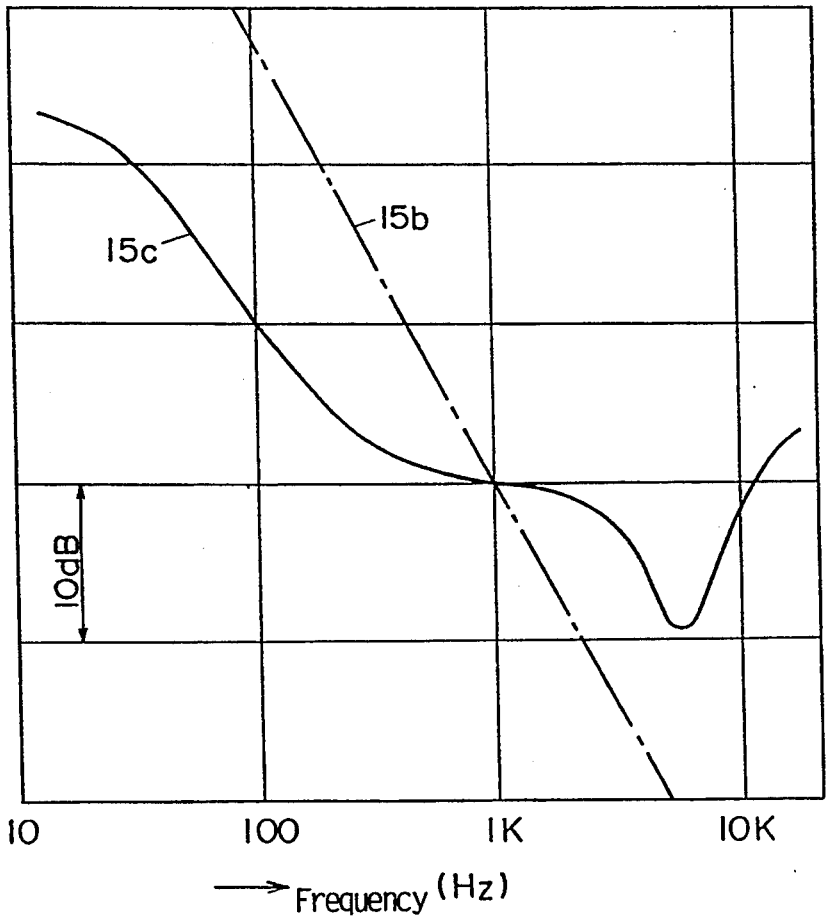
FIG. 9 is a frequency characteristic graph of still another embodiment.

FIG. 9 is a frequency characteristic graph based on still another embodiment. This example combines the attenuating filter of the sound leakage frequency band of the above-mentioned third embodiment with the intensifying filter of only the low frequency band of the above-mentioned first or second embodiment. This means that in FIG. 9, numeral 56 designates a noise frequency characteristic which frequency-analyses the noise in an electric car. For this characteristic, the reproduction frequency characteristic is intensified in the low frequency band part, and the sound leakage frequency band centering 6 kHz is attenuated with a sharp attenuation characteristic.

in this embodiment, as is obvious from FIG. 9, in an electric car. the noise of low-pitched tones is large but the noise of high-pitched tones is small. Accordingly, the listener cannot listen to low-pitched tones in the output from the head phone 47 because it is buried in the noise, and in reverse, it is easy for the listener to listen to the high-pitched tones because the S/N ratio to the noise can be taken large. Therefore, when the attenuating function for the sound leakage frequency band and the intensifying circuit for the low frequency band are operated, the low-pitched tones which are difficult for the listener to listen to is made easy to listen, and the high-pitched tones which the listener listens with much annoyance can be attenuated to a moderated level. Thus the apparatus can provide an ease-to-listen and more natural sound quality. In addition, the apparatus can prevent the surrounding passengers in the car from being annoyed by the sound leakage.

Moreover, the semiconductor inductor 16 in the embodiment may be what is generally called an inductor (coil), which is a passive element.

Also, the head phones 12 and 47 include ear-insert-type head phones which are used often today.

Applicability in Industries

As described above, in the present invention, the noise frequency characteristic frequency-analyzing the amount of noise in an electric car, the noise frequency characteristic frequency-analyzing the amount of noise in a motorcar or the like Is measured in advance, and there are installed the filter, which attenuates the high frequency band and intensifies the low frequency band in a manner to correspond to the above-mentioned noise frequency characteristic, and also the control, which changes-over this filtering operation. The above-mentioned control switch is changed-over to make the frequency characteristic of the reproduction signal correspond to the above-mentioned noise frequency characteristic, and therefore the listener can listen to a nicely balanced sound suitable for the surrounding environment.

Also, in the present invention, the attenuating filter for attenuating the sound leakage frequency and the control switch for changing-over the operation of the attenuating filter are installed, and by turning on or off the control switch the sound leakage from the head phone to the outside in the loaded state can be positively controlled. In case where the apparatus is used in a place filled with large noise such as in a conveyance or in a crowded place, the sound leakage to the outside can be reduced as required, and therefore the apparatus not only gives the listener a sense of case but also can prevent the surrounding people from being annoyed. It can further provide a more natural sound quality in a noisy environment, thus the present invention is very effective.

What is claimed is:

1. An acoustic reproducing apparatus for reducing sound leakage from open-air-type headphones comprising:

an attenuating filter having a pre-fixed sharp attenuation characteristic such that energy components of a maximum amplitude part in a sound leakage frequency band ranging between 4–8 kHz, which are the measured energy components of spectral components of sound leaking from said open-air-type headphones to the environment, is attenuated, all other energy components of sound leakage from said headphones are not sharply attenuated, and wherein attenuation on a 1 kHz part of said sound leakage frequency band is substantially zero; and a control switch for switching an operation of said attenuating filter between a first position, where said energy components of maximum amplitude part in said sound leakage frequency band are selectively attenuated, and a second position, where sound corresponding to the entire spectral range is output to said headphones; and an intensifying filter for intensifying a low frequency band less than 1 kHz of sound output to said open-air-type headphones, wherein said intensifying filter is selectively controlled by said control switch.

2. An acoustic reproducing apparatus in accordance with claim 1, wherein a rate of attenuation per octave of said attenuating filter is at least −12 dB at a center frequency of 6 kHz.

3. An acoustic reproducing apparatus for reducing sound leakage from open-air-type headphones comprising:

a set of open-air-type headphones to be attached to ears of a listener for listening to sound emanating from a source;

an attenuating filter whose characteristic is prefixed to reduce energy components of a maximum amplitude part in a sound leakage frequency band from said open-air-type headphones to the environment and so that all other energy components of sound leakage from said open-air-type headphones are not significantly reduced;

a control switch for switching an operation of said attenuating filter between a first position where said energy components of maximum amplitude part in said sound leakage frequency band are selectively attenuated and a second position where the sound of the whole spectral range is output to said headphones; and an intensifying filter for intensifying a low frequency band less than 1 kHz of sound output to said open-air-type headphones, wherein said intensifying filter is selectively controlled by said control switch.

* * * * *